US007476133B2

(12) United States Patent
Tanaka et al.

(10) Patent No.: US 7,476,133 B2
(45) Date of Patent: Jan. 13, 2009

(54) CONNECTOR

(75) Inventors: Tsutomu Tanaka, Yokkaichi (JP); Tsuyoshi Mase, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/116,654

(22) Filed: May 7, 2008

(65) Prior Publication Data

US 2008/0280489 A1 Nov. 13, 2008

(30) Foreign Application Priority Data

May 8, 2007 (JP) ..... 2007-123143

(51) Int. Cl.
*H01R 13/514* (2006.01)

(52) U.S. Cl. ..... 439/752

(58) Field of Classification Search ..... 439/598, 439/701, 695, 686, 903, 589, 488–489, 595, 439/352, 752.5, 357–358, 596, 752, 372, 439/350

See application file for complete search history.

(56) References Cited

U.S. PATENT DOCUMENTS 5,145,356 A * 9/1992 Minnis ..... 439/352
5,336,101 A * 8/1994 Kasugai et al. ..... 439/272
5,520,553 A 5/1996 Cecil, Jr. et al.
5,651,703 A * 7/1997 Sasai ..... 439/752
7,001,215 B2 2/2006 Nakamura
2002/0146281 A1 10/2002 Murakami
2005/0176289 A1 8/2005 Flowers et al.

FOREIGN PATENT DOCUMENTS

EP 1289071 A2 3/2003

* cited by examiner

*Primary Examiner*—Edwin A. Leon
(74) *Attorney, Agent, or Firm*—Gerald E. Hespos; Anthony J. Casella

(57) ABSTRACT

A housing main body (1) is formed with rear cavities (5B-1), and a lance housing (2) including locking lances (18) is formed with front cavities (5B-2). When the lance housing (2) is mounted into a mounting space (10) of the housing main body (1), locks (22) of eaves (20) are resiliently engaged with hooking claws (14) formed on wall surfaces of the mounting space (10). Since deformation spaces (21) for the eaves (20) are open at the front, if the locks (22) and the hooking claws (14) are incompletely engaged, such a state can be visually confirmed from the front side of the housing main body (1).

10 Claims, 14 Drawing Sheets

CONNECTOR

BACKGROUND OF THE INVENTION

1. Field of the Invention

The invention relates to a connector.

2. Description of the Related Art

U.S. Pat. No. 7,001,215 discloses a connector with an inner housing and an outer housing. The outer housing of the connector includes a receptacle with an open front end, and the inner housing is fit into the outer housing from the front of the receptacle. A lock claw projects from the back wall of the inner housing and is engageable with an interlocking portion of the outer housing to fix the inner housing.

The inner housing is locked at the rear of the back wall in the connector disclosed in U.S. Pat. No. 7,001,215. Thus, there is a problem that the locked state cannot be seen from the outside at the front of the receptacle.

The invention was developed in view of the above situation and an object thereof is to provide a connector with a housing made up of a plurality of members, enabling easy visual confirmation of an engaged state of the members from the outside.

SUMMARY OF THE INVENTION

The invention relates to a connector with a housing main body formed with at least one rear cavity for accommodating a rear side of a terminal fitting. A lance housing is mountable on the front surface of the housing main body and is formed with at least one front cavity that communicates with the rear cavity. The front cavity accommodates a front side of the terminal fitting when the lance housing is mounted, and has at least one resilient lance that is engageable with the terminal fitting. An interlocking portion is formed in a mounting area of the housing main body for the lance housing. The lance housing includes at least one resiliently deformable lock and a forwardly open deformation space having at least one locking portion formed in a part thereof. The locking portion engages the interlocking portion for retaining the lance housing in the housing main body.

The resiliently deformable lock preferably extends forward from a rear part of the lance housing to form the deformation space.

The lock of the lance housing is engaged with the interlocking portion of the housing main body while being resiliently deformed. The deformation space for the lock is exposed to the front in this assembled state. Thus, the open state of the deformation space easily can be confirmed visually from the front. The deformation space is widely open if the lock is engaged properly with the interlocking portion, whereas the deformation space is closed if the lock is engaged incompletely. In this way, the open area of the deformation space differs depending on the engaged state of the lock and an operator can easily visually identify such a state.

The lance housing is mounted into the housing main body from the front and hence from a direction in which the open state of the deformation space is seen. Accordingly, the assembling of the lance housing can be confirmed simultaneously with the assembling operation.

At least one retainer preferably is mountable into or onto the lance housing from the front and includes at least one unlock preventing piece for preventing the resilient deformation of the lock by entering the deformation space. Accordingly, a force for locking the lance housing can be increased. Further, the lock remains resiliently deformed if the lance housing is assembled incompletely. As a result, the unlock preventing piece contacts the lock, making it impossible to mount the retainer any further. The incompletely assembled state of the lance housing also can be detected by the feeling at this time. Alternatively, strong pushing forces on the retainer can push the incompletely assembled lance housing to a proper assembled position due to the abutting engagement of the unlock preventing piece with the lock.

The retainer preferably has at least one lance restricting piece for entering a deformation space for the lance and preventing deformation of the lance when the retainer is mounted into the lance housing. Accordingly, the retainer can prevent deformations of both the lock and the lance to reduce the number of parts and to simplify the construction of the entire connector.

The retainer preferably can be held at a first position where the retainer is mounted lightly in the lance housing and at a second position where the retainer is mounted deeply in or on the lance housing.

The unlock preventing piece preferably enters the deformation space for the lock when the retainer is at the first position, but the lance restricting piece is not in the deformation space for the lance. Thus, the terminal fitting can be inserted into the front and rear cavities. However, the unlock preventing piece and the lance restricting piece both are in the deformation spaces therefor when the retainer is at the second position. Accordingly, the retainer can be united with the housing in its partly locked state, and the connector can be transported, for example, to a site where the terminal fitting is inserted. In this case, the unlock preventing piece already is in the deformation space for the lock and prevents deformation of the lock. Thus, the lance housing will not separate during transportation. On the other hand, the lance restricting pieces is not yet in the deformation space for the lance when the retainer is at the first position and the lance can deform freely so that the terminal fitting can be inserted.

The front cavity of the lance housing preferably is formed with one or more front-stop surfaces for preventing the terminal fitting from moving any further forward.

At least one insertion recess preferably is formed in a wall surface where the front ends of the rear cavities make openings. The insertion recess is provided for receiving at least one guiding shaft on the retainer.

At least one sealing tower preferably is formed near the rear ends of the rear cavities. At least one resilient plug mounted on the wires and connected with the terminal fitting can be accommodated in the sealing tower.

The housing main body preferably has at least one large cavity for accommodating at least one large terminal fitting. The large cavity is formed integrally or unitarily with a locking lance.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
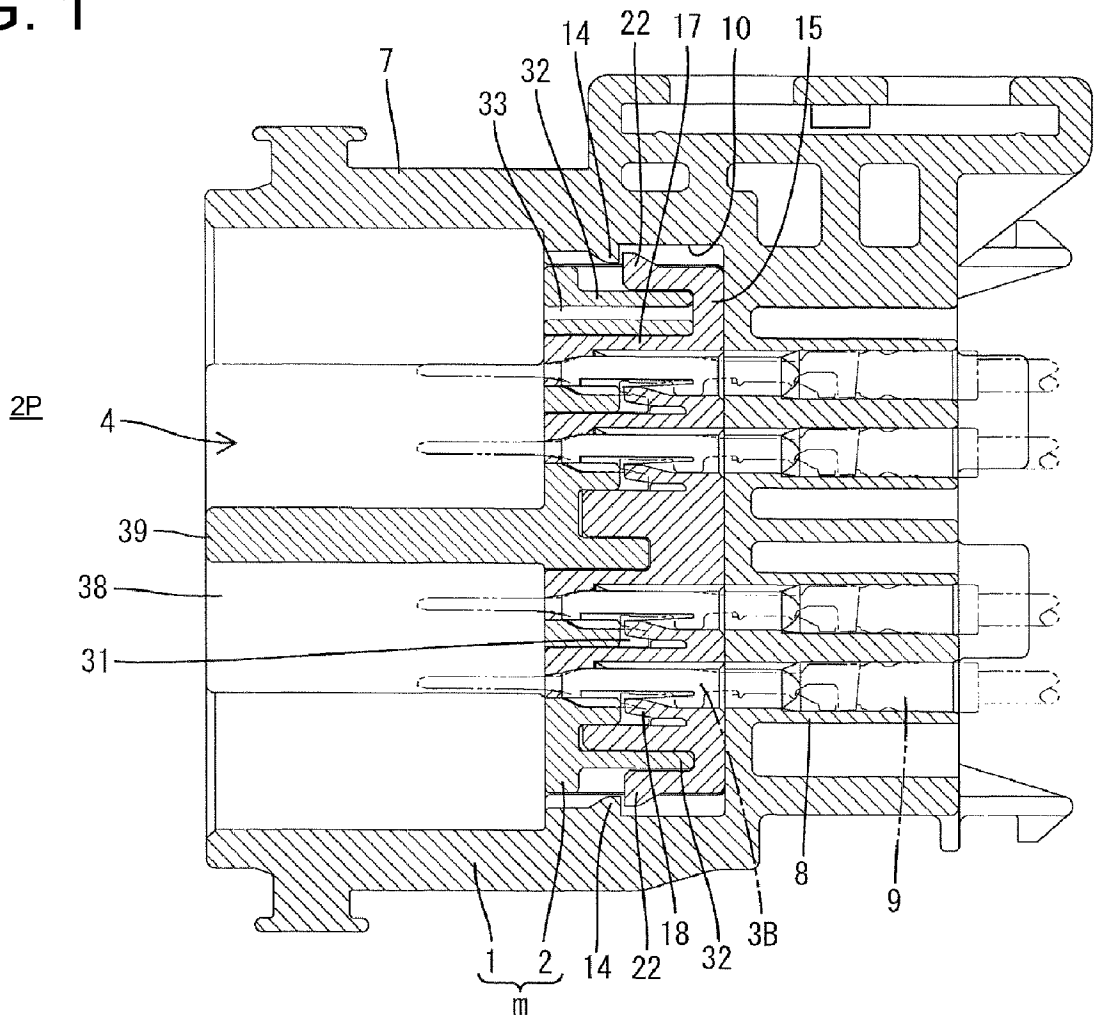
FIG. 1 is a side view in section of a connector when a retainer is fully locked.
Figure 2:
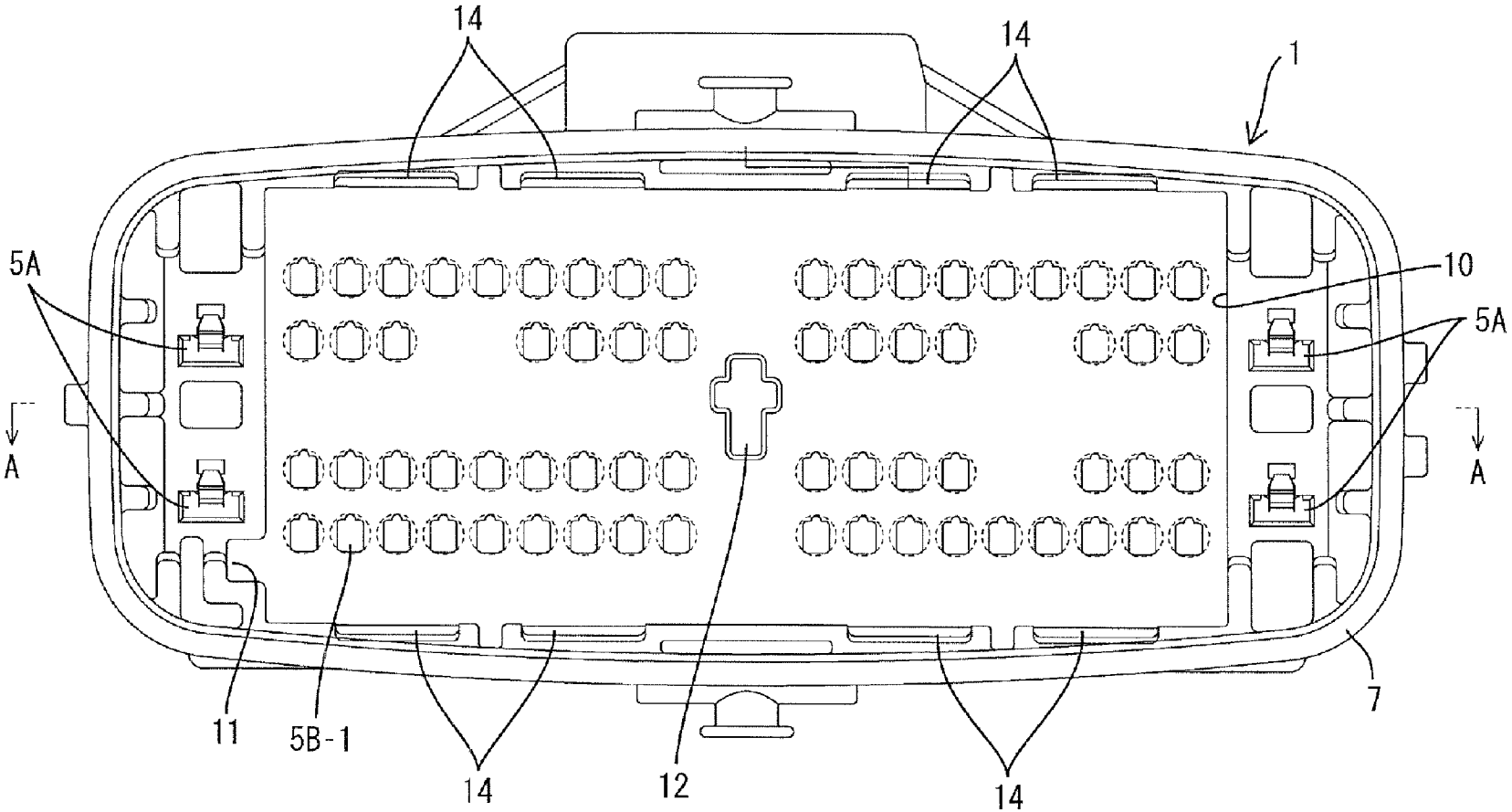
FIG. 2 is a front view of a housing main body.

A male connector in accordance with the invention is described with reference to FIGS. 1 to 14. As shown in FIG. 1, the connector has a housing comprised of a housing main body 1 and a lance housing 2 that can be assembled with the housing main body 1. The end of the connector to be connected to a mating connector (not shown) is referred to herein as the front.

The housing main body 1 is formed unitarily e.g. of a synthetic resin. Upper and lower large cavities 5A penetrate a back side of the housing main body 1 at each of the opposite widthwise sides of the housing main body 1 for accommodating large terminals 3A. The upper and lower large cavities 5A are paired with respect to the width direction. Small cavities 5B also penetrate a back side of the housing main body 1 and are arranged substantially side by side in the width direction at each of four stages between the large cavities 5A. The small cavities 5B accommodate small terminals 3B As shown in FIG. 1, the large cavities 5A are have a length to accommodate the entire large terminals 3A except tabs thereof, whereas the small cavities 5B have divided front and rear parts to accommodate rear parts of the small terminals 3B. Thus, the housing main body 1 is formed with only rear cavities 5B-1 for accommodating the rear portions of the small terminals 3B. Although described in detail later, front cavities 5B-2 are formed in the lance housing 2. Lances 6 for locking the small terminals 3B in the small cavities 5B are formed separately from the housing main body 1 for the following reason. More particularly, the connector of this embodiment must accommodate differently dimensioned terminal fittings 3A, 3B, and hence requires differently dimensioned cavities 5A, 5B. Progress has been made in recent years in the miniaturization of connectors. However, a molding material does not easily spread around the smaller cavities during molding, and it is difficult to mold complicated structures, such as locking lances in small cavities. Accordingly, the small cavities 5B are molded while being divided into parts including the lances 6 and the remaining parts.

The lances 6 are formed unitarily with the housing main body 1 and cantilever forward from positions near the front ends of the larger cavities 5A. The lances 6 are resiliently deformable in the height direction and are engageable with the large terminals 3A to retain them. The tabs of the large terminals 3A project from the cavities 5A and into a receptacle 7 when the large terminals 3A are mounted. Substantially cylindrical sealing towers 8 project back from the rear of the housing main body 1 to define parts of the respective larger cavities 5A. The sealing towers 8 accommodate resilient plugs 9 mounted near ends of wires and crimped into connected with the large terminals 3A. Sealing towers 8 also are formed at the rear ends of the small cavities 5B.

Figure 3:
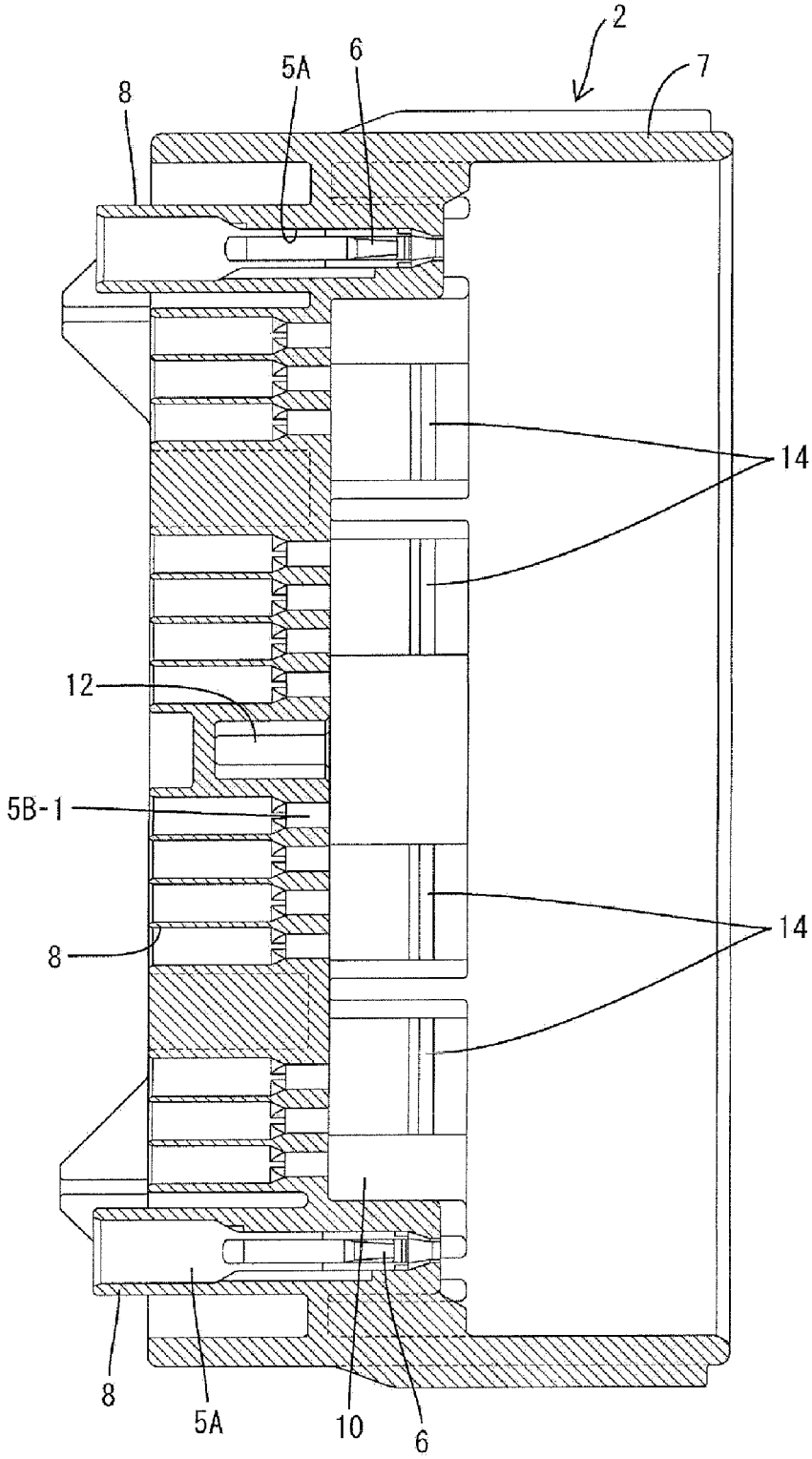
FIG. 3 is a section along A-A of FIG. 2.
Figure 4:
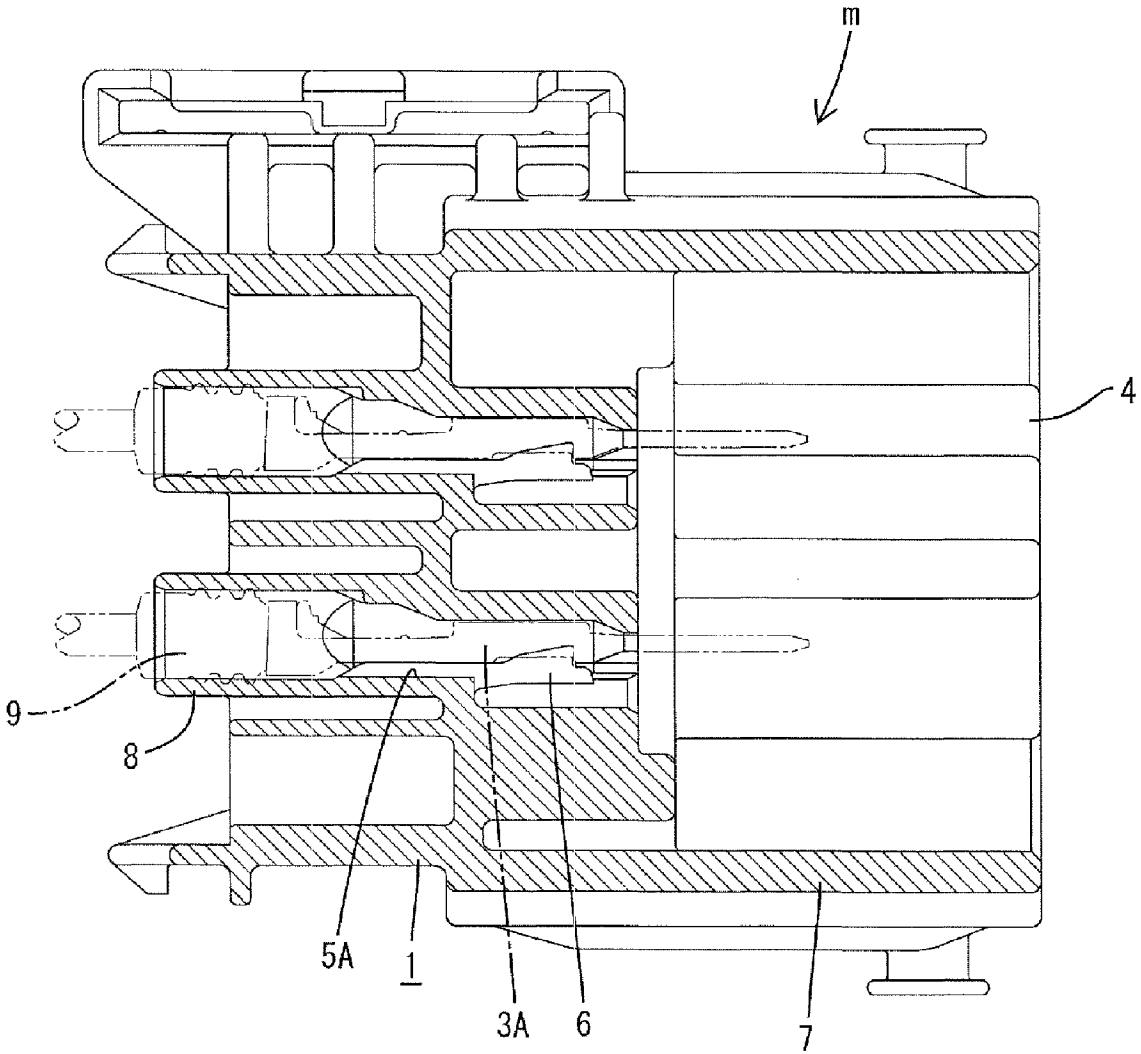
FIG. 4 is a view corresponding to FIG. 1 showing a part including larger cavities.
Figure 5:
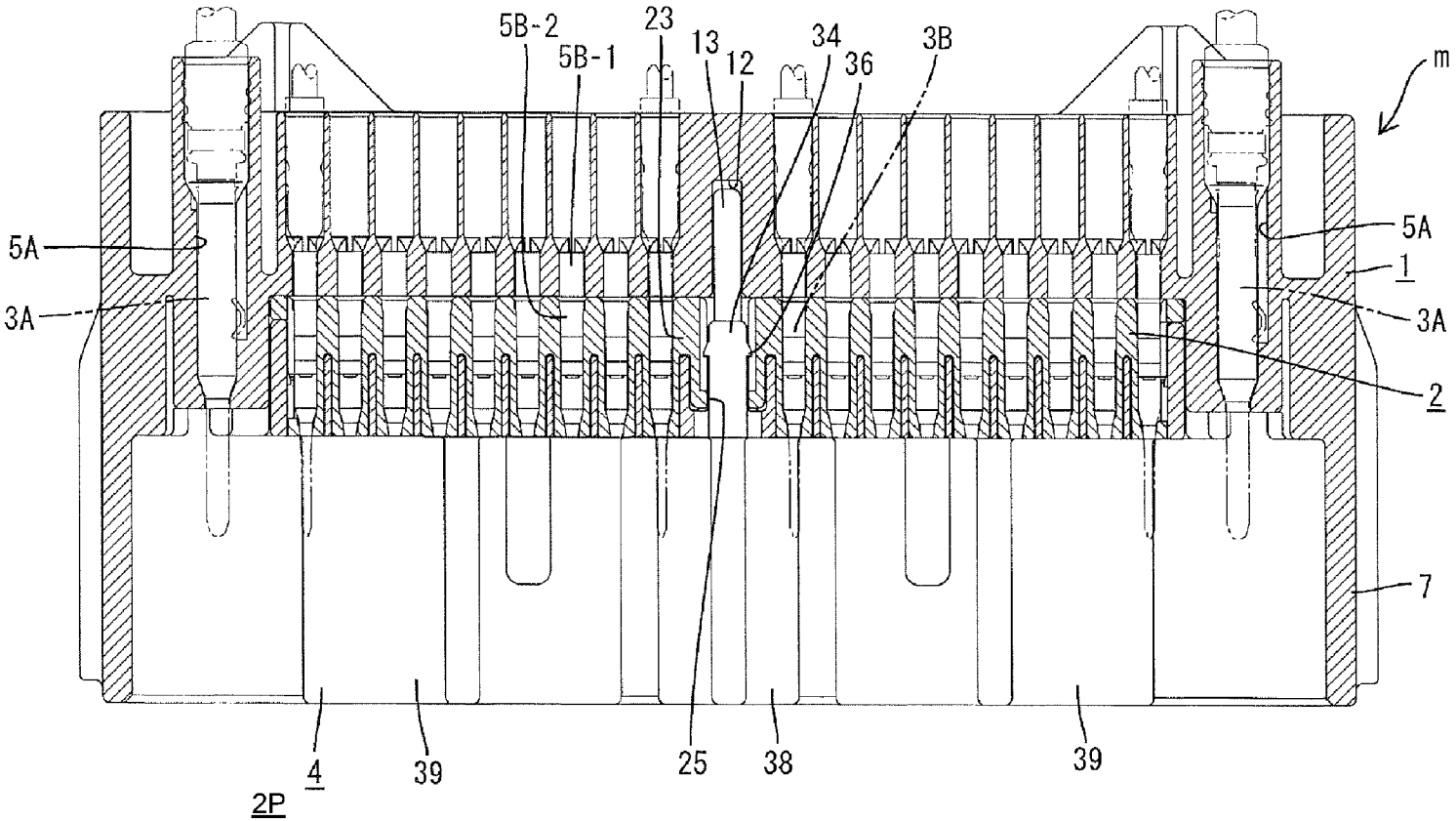
FIG. 5 is a plan view in section of the connector when the retainer is fully locked.
Figure 6:
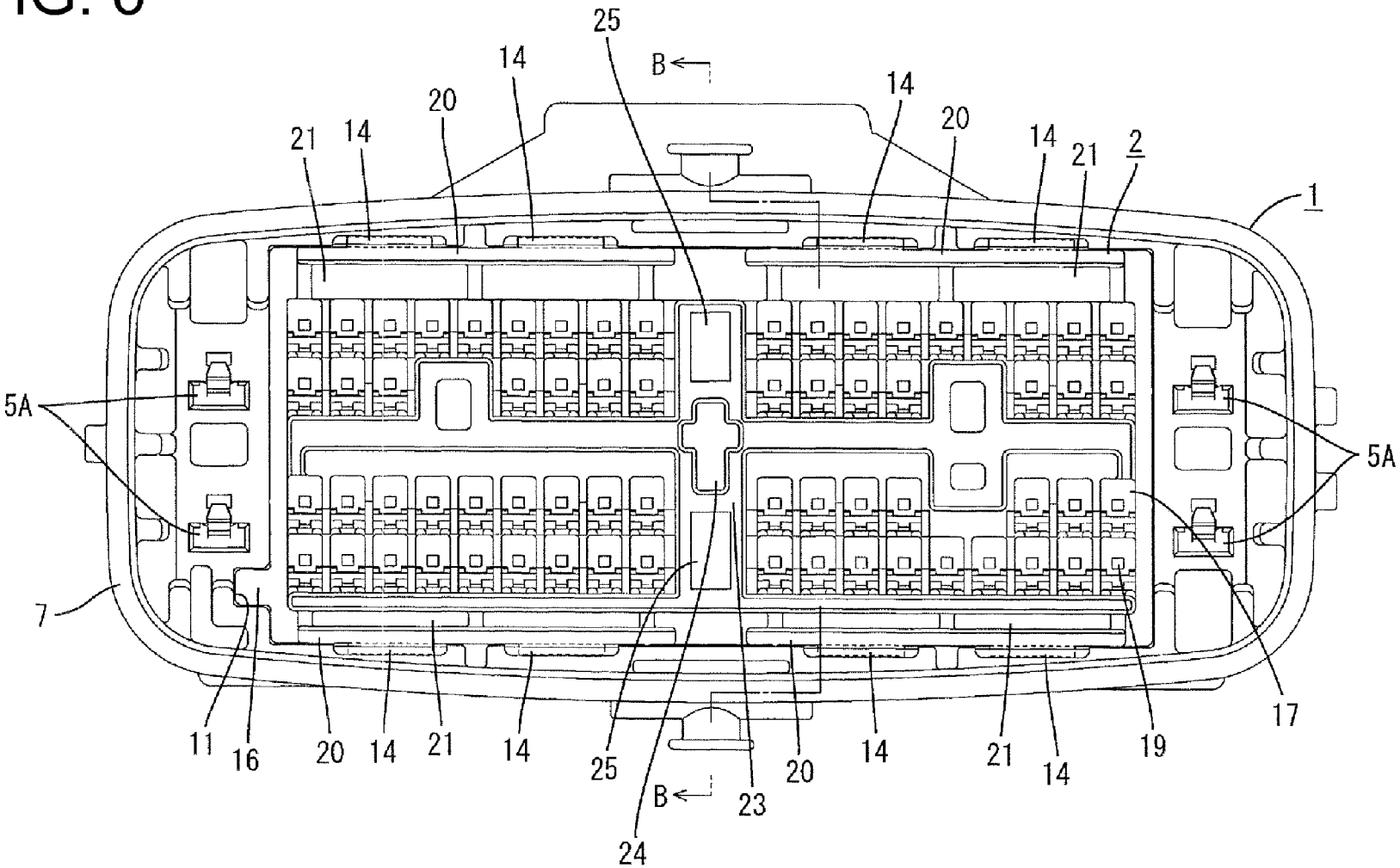
FIG. 6 is a front view showing a state where a lance housing is mounted in the housing main body.

As described above, the front cavities 5B-2 of the small cavities 5B are separated and only the rear cavities 5B-1 are formed in the housing main body 1. Thus, as shown in FIG. 3, the front end surfaces of the rear cavities 5B-1 are located behind the front end surfaces of the large cavities 5A, and a mounting space 10 for receiving the lance housing 2 is formed by retracting the rear cavities 5B-1 (see FIG. 3). The mounting space 10 is surrounded in height and width directions, but has an open front. An escaping groove 11 is formed in the left wall of FIG. 2 below the lower large cavity 5A and for preventing the inverted insertion of the lance housing 2 and a retainer 4.

A substantially cross-shaped insertion recess 12 is formed in a wall surface where the front ends of the rear cavities 5B-1 make openings. The insertion recess 12 receives at least one guiding shaft 13 on the retainer 4, and has a specified depth. Hooking claws 14 for primarily locking the lance housing 2 are provided on opposite wall surfaces of the mounting space 10 facing in the height direction (see FIGS. 1 and 3). The hooking claws 14 are formed four positions along the width direction on each of the upper and lower surfaces so that hooking claws 14 and distributed equally on each of the right and left sides of the insertion recess 12.

Figure 8:
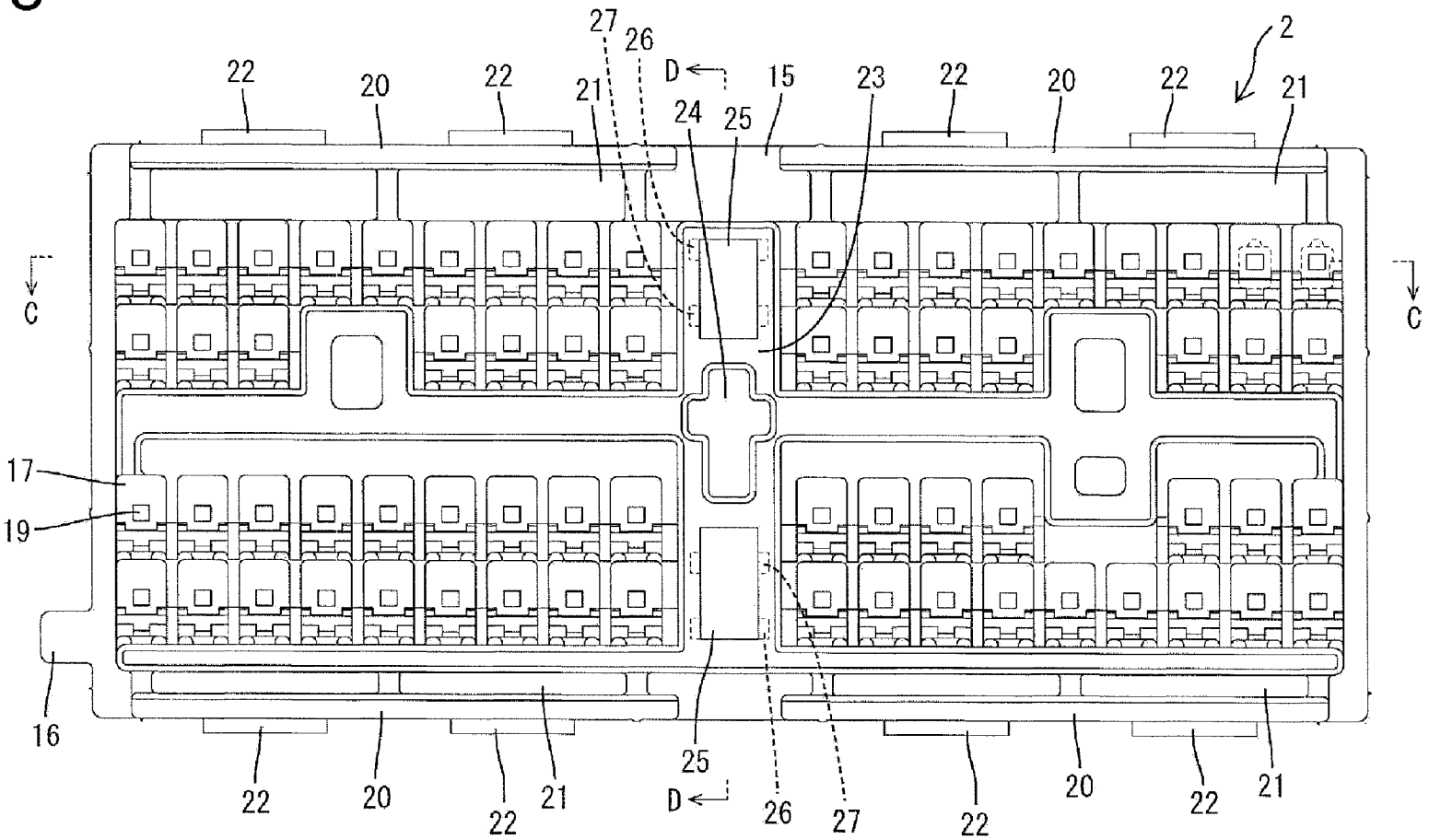
FIG. 8 is a front view of the lance housing.
Figure 9:
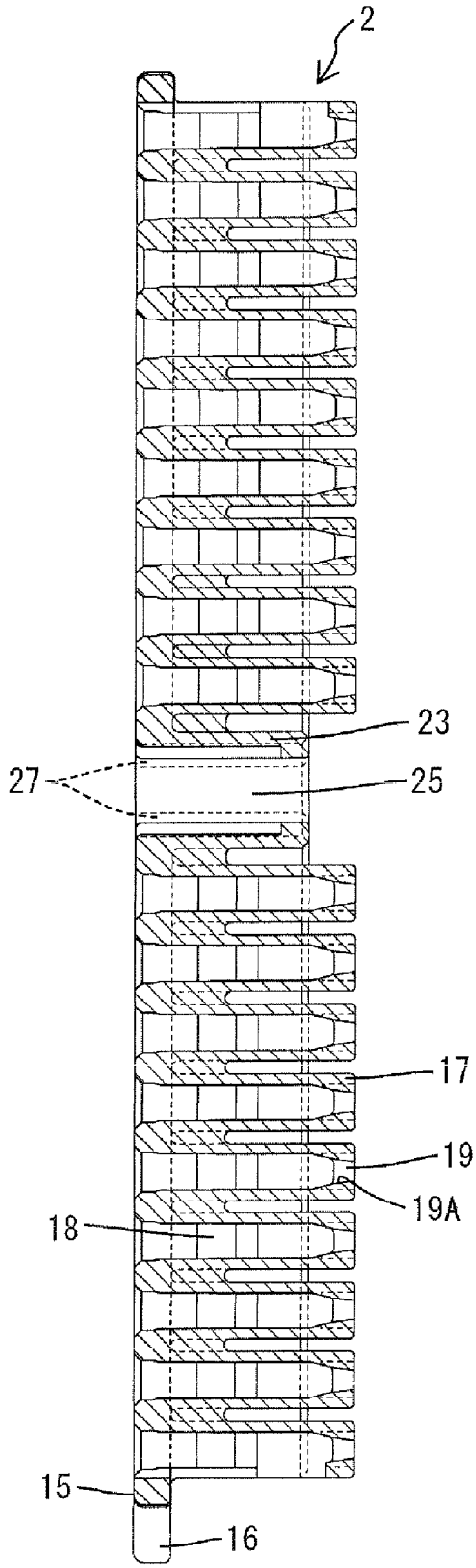
FIG. 9 is a section along C-C of FIG. 8.

The lance housing 2 is formed unitarily e.g. of a synthetic resin and includes a base plate 15 that can fit into the mounting space 10. As shown in FIG. 8, a housing-side projection 16 projects out in the width direction at the left corner of the base plate 15. The projection 16 can be inserted into the escaping groove 11 when the lance housing 2 is mounted in a substantially proper posture into the housing main body 1, but interferes with the housing main body 1 to prevent mounting of the lance housing 2 into the mounting space 10 when the lance housing 2 is inverted.

Figure 7:
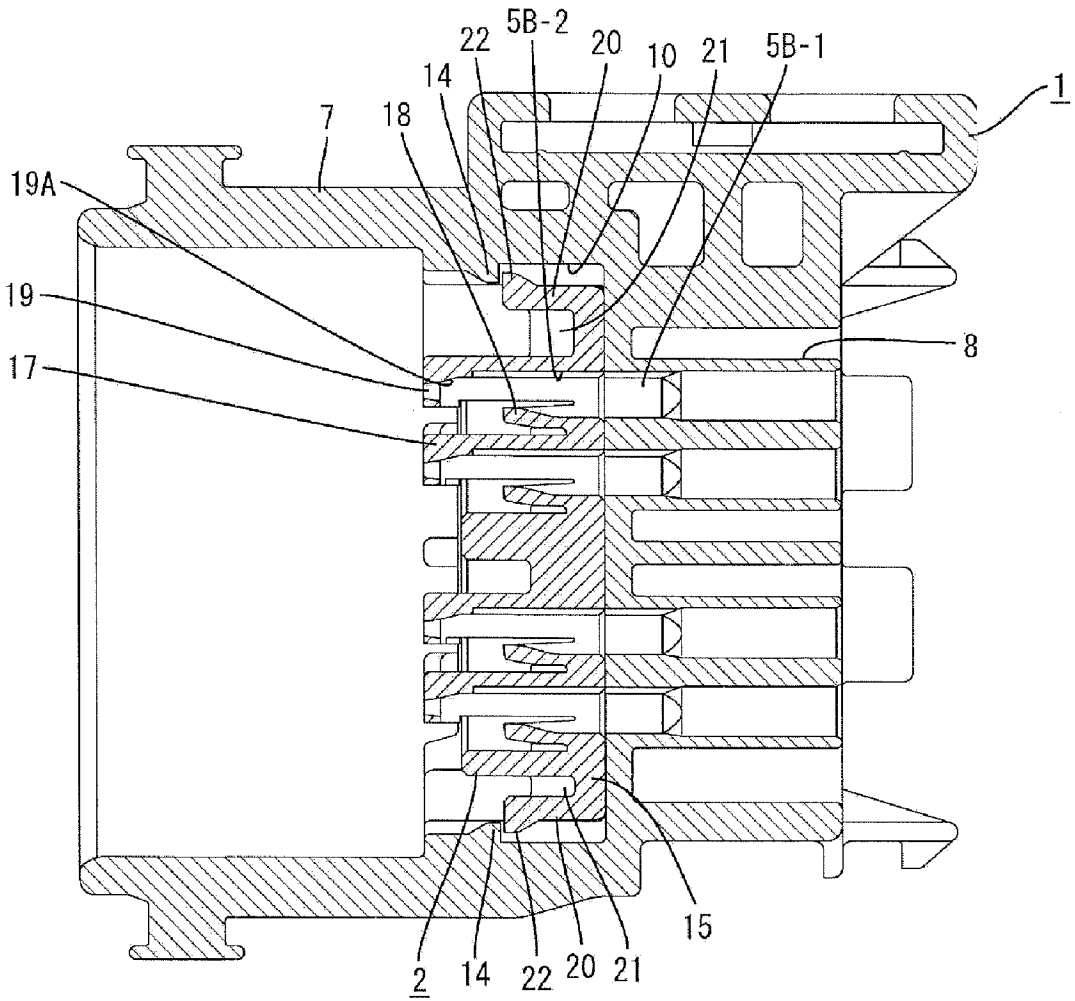
FIG. 7 is a section along B-B of FIG. 6.

Cavity tubes 17 project from the front surface of the base plate 15, and the front cavities 5B-2 penetrate the cavity tubes 17 in forward and backward directions. The front cavities 5B-2 align coaxially with the corresponding rear cavities 5B-1 when the lance housing 2 is assembled with the housing main body 1. Resiliently deformable lances 18 are formed unitarily in the bottom surfaces of the respective front cavities 5B-2 and cantilever obliquely forward. Deformation spaces 18A are defined on sides of the locking lances 18 opposite the respective front cavities 5B-2. The lances 18 are engageable with the small terminals 3B when the small terminals 3B are inserted to proper depths into the small cavities 5B. Tab insertion holes 19 are formed in the front wall of the lance housing 2 and can receive the tabs of the small terminals 3B. Front-stop surfaces 19A are define adjacent the inner circumferential surfaces of the tab insertion holes 19 to limit forward insertion of the small terminals 3B. As shown in FIG. 7, parts of the front wall of the lance housing 2 adjacent below the tab insertion holes 19 are cut off to expose the entire lances 18 forward.

Eaves 20 project substantially horizontally forward at the opposite upper and lower edges of the base plate 15 except their middle parts. The eaves 20 are at specified distances to the outer surfaces of the corresponding cavity tubes 17 facing in the height direction. The projecting lengths of the eaves 20 are more than about one third (preferably about half) the length of the cavity tubes 17. This projecting length is set to permit satisfactory resilient deformations of the eaves 20 towards deformation spaces 21 defined between the eaves 20 and the cavity tubes 17. Locks 22 are formed at positions near the front end edge of each eave 20 and extend over a width range of each eave 20 substantially corresponding to the hooking claws 14 of the housing main body 1. The hooking claws 14 contact the respective locks 22 in the process of fitting the lance housing 2 into the mounting space 10 of the housing main body 1 and cause the eaves 20 to deform into the deformation spaces 21. The eaves 20 then restore resiliently after sufficient insertion into the mounting space 10 so that the locks 22 engage the hooking claws 14 (see FIG. 7). As is clear from FIG. 7, the deformation spaces 21 for the respective locks 22 are open at the front. Thus, the engaged state of the locks 22 with the respective hooking claws 14 can be confirmed visually from the front of the receptacle 7.

The deformation spaces 21 at upper parts of the lance housing 2 have a larger height dimension than other deformation spaces 21.

Figure 10:
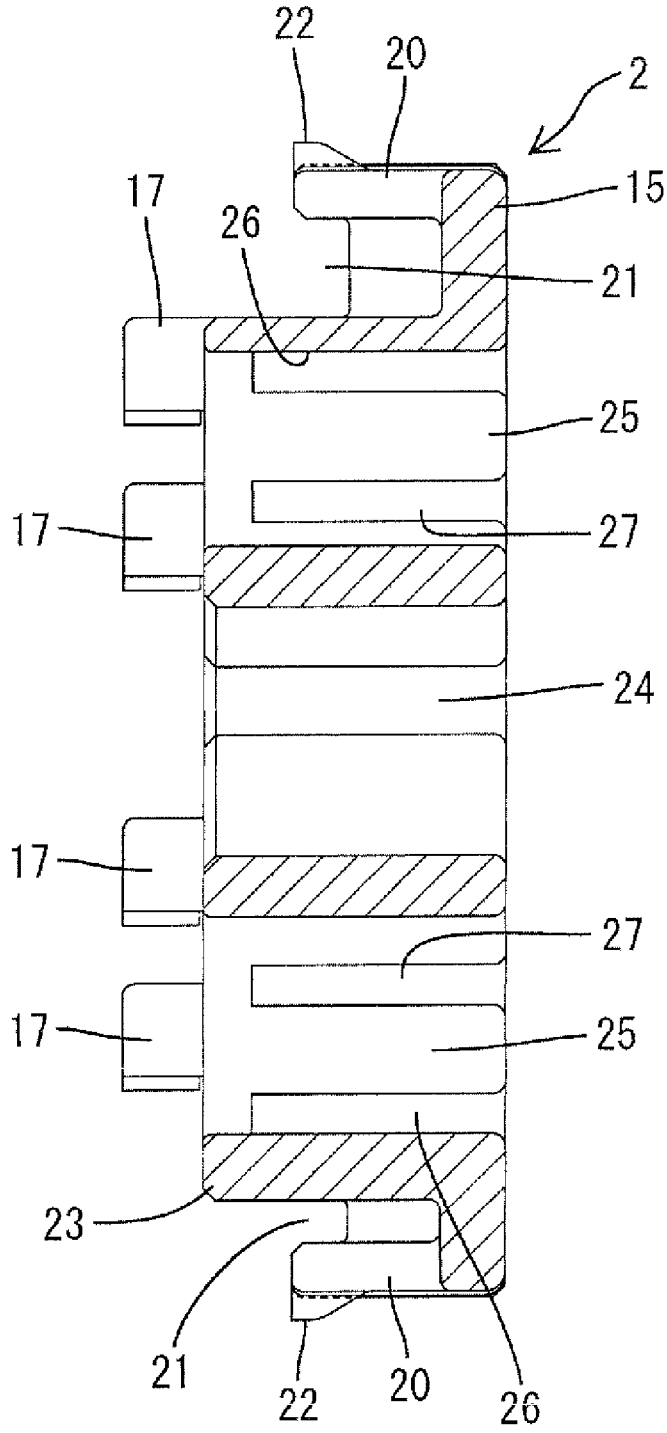
FIG. 10 is a section along D-D of FIG. 8.

A substantially block-shaped projection 23 projects unitarily forward from an intermediate part of the base plate 15 and divides the small cavities 5B into left and right groups. The projecting distance of the block-shaped projection 23 from the base plate 15 is less than the projecting distance shorter than the cavity tubes 17 from the base plate 15. A window 24 penetrates an intermediate part of the block-shaped projection 23 particularly in the height direction. The window 24 has substantially the same cross-shape as the insertion recess 12 and is aligned to communicate coaxially with the insertion recess 12 when the lance housing 2 is assembled with the housing main body 1. Substantially rectangular upper and lower retainer locking holes 25 penetrate the block-shaped projection 23 in forward and backward directions at substantially symmetrical positions in the height direction with respect to the window 24. Two pairs of locking grooves 26, 27 are formed in the opposite side wall surfaces of each retainer locking hole 25 facing in the width direction (only one widthwise side is shown in FIG. 10). The locking grooves 26, 27 starts from positions slightly retracted from the front opening planes of the retainer locking holes 25. A retainer 4 is engageable at these starting positions, and extends horizontally to the rear end of the lance housing 2. The locking grooves 26 located more outward in the height direction of the retainer locking holes 25 are for partial locking and the locking grooves 27 located more inward for full locking.

Figure 11:
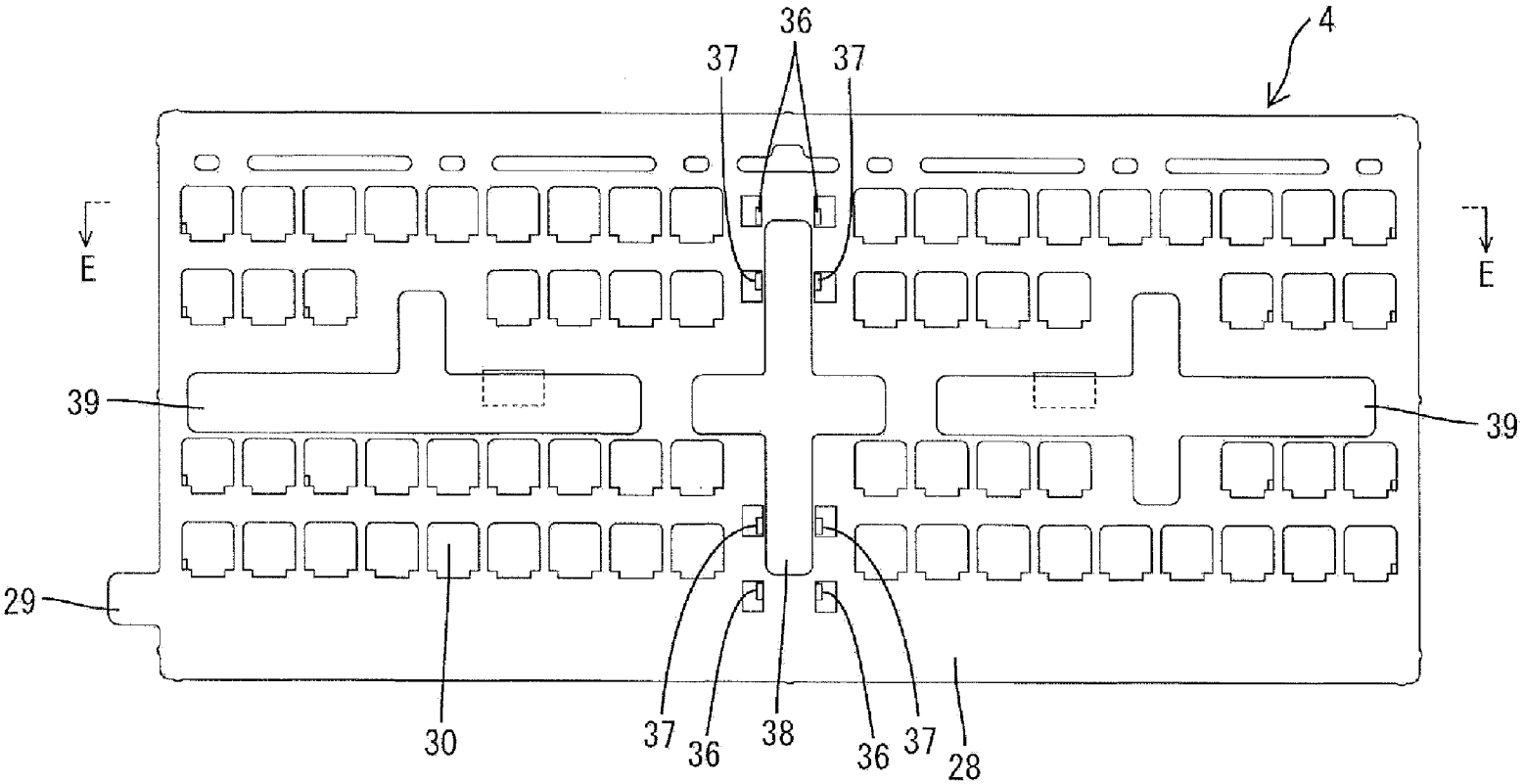
FIG. 11 is a front view of the retainer.

The retainer 4 is formed unitarily e.g. of a synthetic resin and includes a base 28 configured to surround substantially the entire area of the lance housing 2 where the cavity tubes 17 are provided. A retainer-side projection 29 projects out in the width direction from the left corner of the base 28 as shown in FIG. 11, and can fit into the escaping groove 11 together with the housing-side projection 16 when the retainer 4 is assembled into the housing main body 1 in a proper posture. However, the retainer-side projection 29 interferes with a part of the housing main body 1 to make assembly impossible if the retainer 4 is in an inverted or wrong posture.

The retainer 4 is movable between a partial locking position (1P in FIG. 14) where the retainer 4 is fit lightly in the lance housing 2 and a full locking position (2P in FIG. 1) where the retainer is fit deeply fitted in the lance housing 2.

Tab introducing holes 30 are formed in the front surface of the base 28 and can be aligned substantially coaxially with the respective tab insertion holes 19 of the front cavities 5B-2. Lance restricting pieces 31 project substantially horizontally back in a mounting direction from the rear surface of the base 28 at lower sides of the opening edges of the respective tab introducing holes 30. The lance restricting pieces 31 are located before the deformation spaces 18A of the lances 18 when the retainer 4 is at the partial locking position 1P so that the lances 18 can deform.

Figure 14:
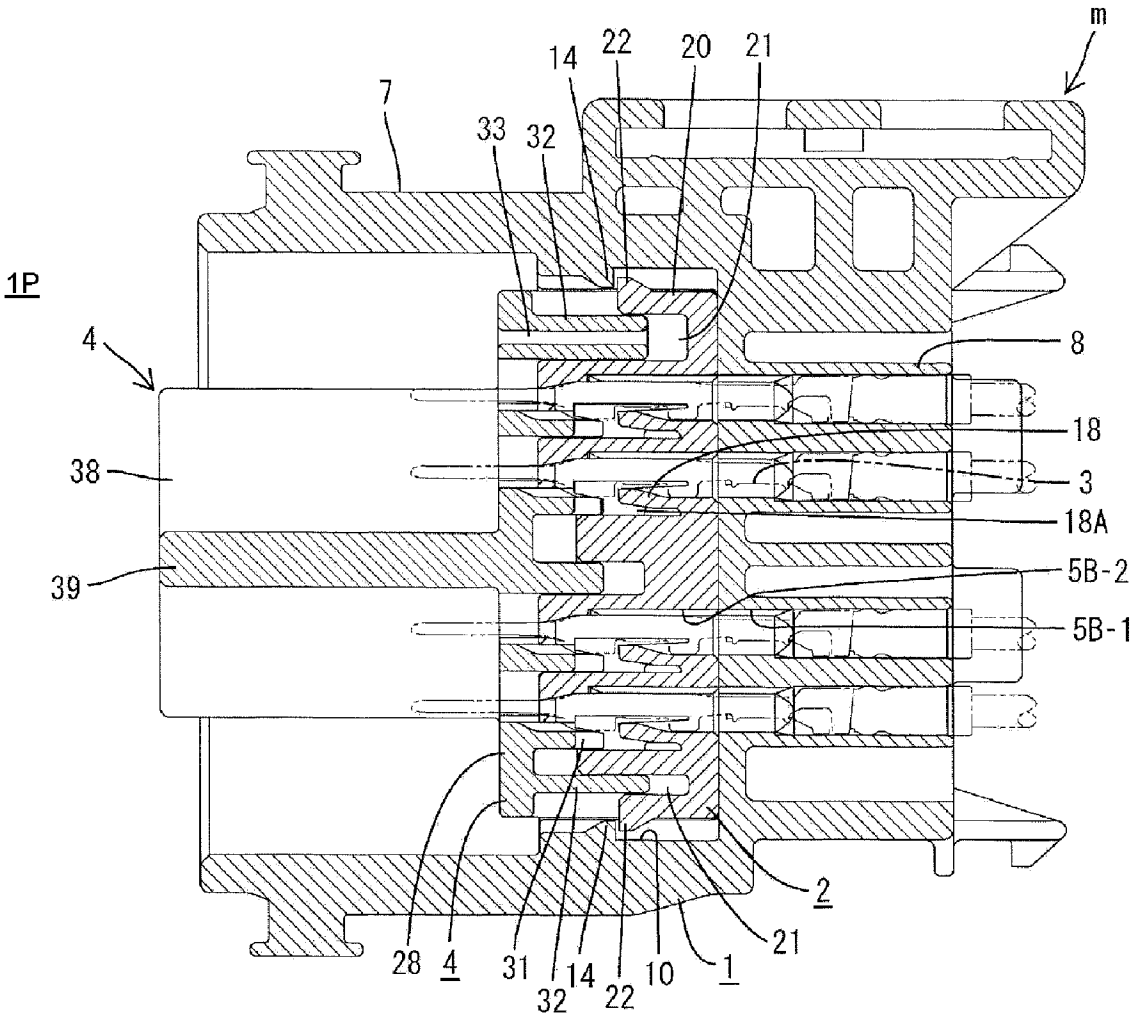
FIG. 14 is a side view in section of the connector when the retainer is partly locked.

Unlock preventing pieces 32 project substantially horizontally back along the mounting direction from positions on the rear surface of the base 28 near the opposite lateral upper and lower edges in correspondence with the deformation spaces 21 for the respective eaves 20. The upper and lower deformation spaces 21 for the locks 22 have different dimensions in the height direction, as described above. Thus, the upper unlock preventing pieces 32 are thicker than the lower ones in the retainer 4, but are formed with suitable thinning 33 to prevent sink marks. As shown in FIG. 14, the leading ends of the unlock preventing pieces 32 are already slightly in the deformation spaces 21 when the retainer 4 is at the partial locking position 1P, and prevent deformations of the eaves 20 in unlocking directions. The unlock preventing pieces 32 are inserted more deeply towards the back ends of the deformation spaces 21 when the retainer 4 is at the full locking position 2P.

Figure 13:
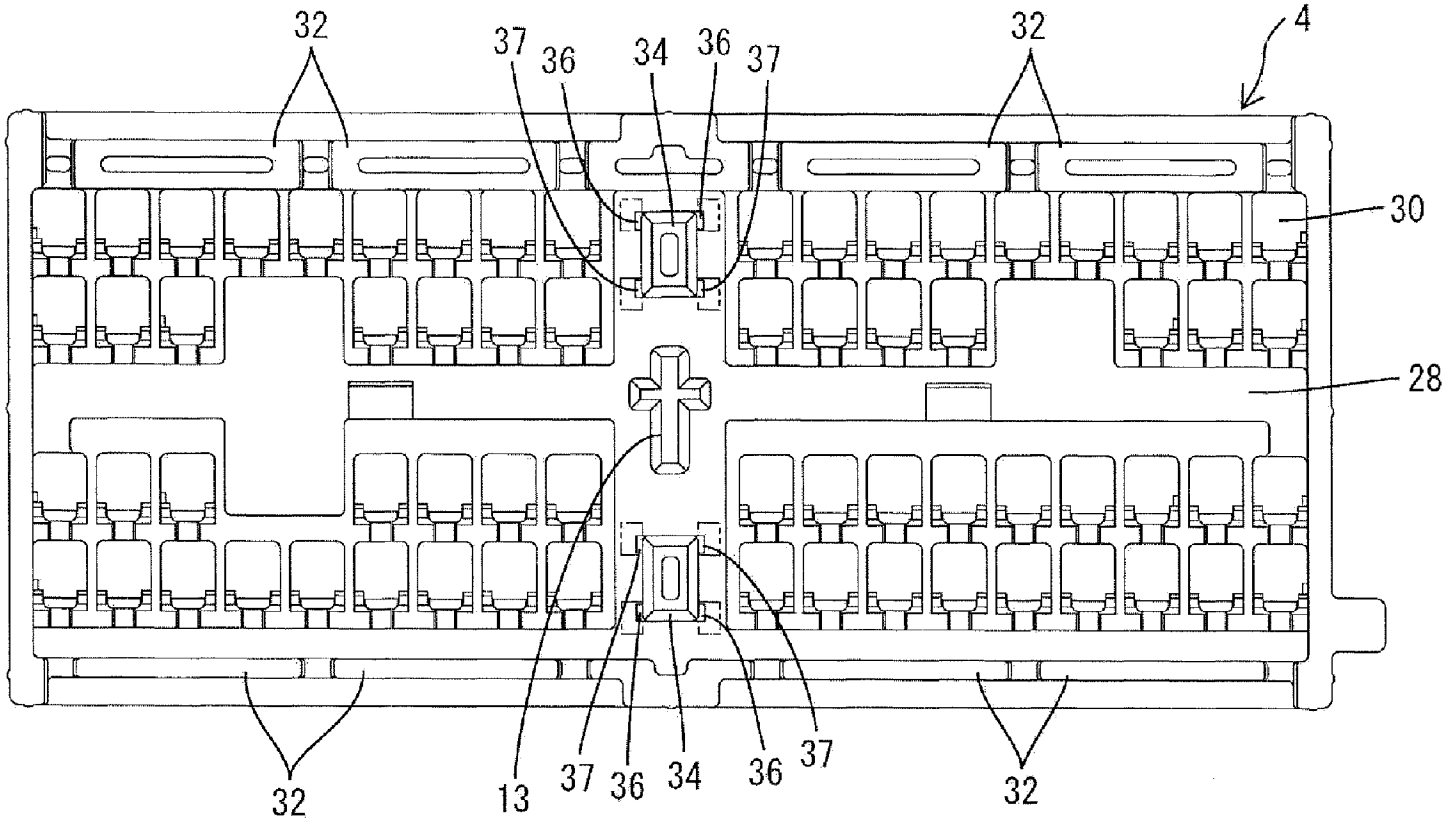
FIG. 13 is a rear view of the retainer.

As shown in FIG. 13, the guiding shaft 13 projects horizontally back in an intermediate part of the rear surface of the base 28. The guiding shaft portion 13 has a cross-shaped cross section substantially in conformity with the shapes of the window 24 of the lance housing 2 and the insertion recess 12 of the housing main body 1. Therefore the guiding shaft 13 can be inserted into the window 24 and/or the insertion recess 12. The guiding shaft 13 has a length to be inserted lightly into the insertion recess 12 when the retainer 4 is at the partial locking position 1P while being more deeply inserted into the insertion recess 12 when the retainer 4 is at the full locking position 2P (see FIG. 5).

Two locking shafts 34 project on the rear surface of the base 28 substantially parallel with the guiding shaft 13 and at opposite sides of the guiding shaft 13 in the height direction. The locking shafts 34 are shorter than the guiding shaft 13 and have substantially the same projecting length as the unlock preventing pieces 32 of the base 28 and a peripheral frame 35 of the base 28. The locking shafts 34 are rectangular columns bored substantially along their central axes. Partial locking projections 36 and full locking projections 37 are formed on the outer surfaces of the locking shafts 34 facing in the width direction for holding the retainer 4 at the partial locking position 1P and the full locking position 2P. The partial locking projections 36 are at positions near the leading ends of the locking shafts 34 and near the outer end edges in height direction (i.e. near the upper edge in the upper locking shaft 34 and near the lower edge in the lower locking shaft 34 in FIG. 13). The partial locking projections 36 engage the front ends of the locking grooves 26 to hold the retainer 4 at the partial locking position 1P. The full locking projections 37 are formed at positions in the longitudinal centers of the locking shafts 34 near the inner end edges in the height direction. The full locking projections 37 are engaged with the front ends of the locking grooves 27 to hold the retainer 4 at the full locking position 2P.

Figure 12:
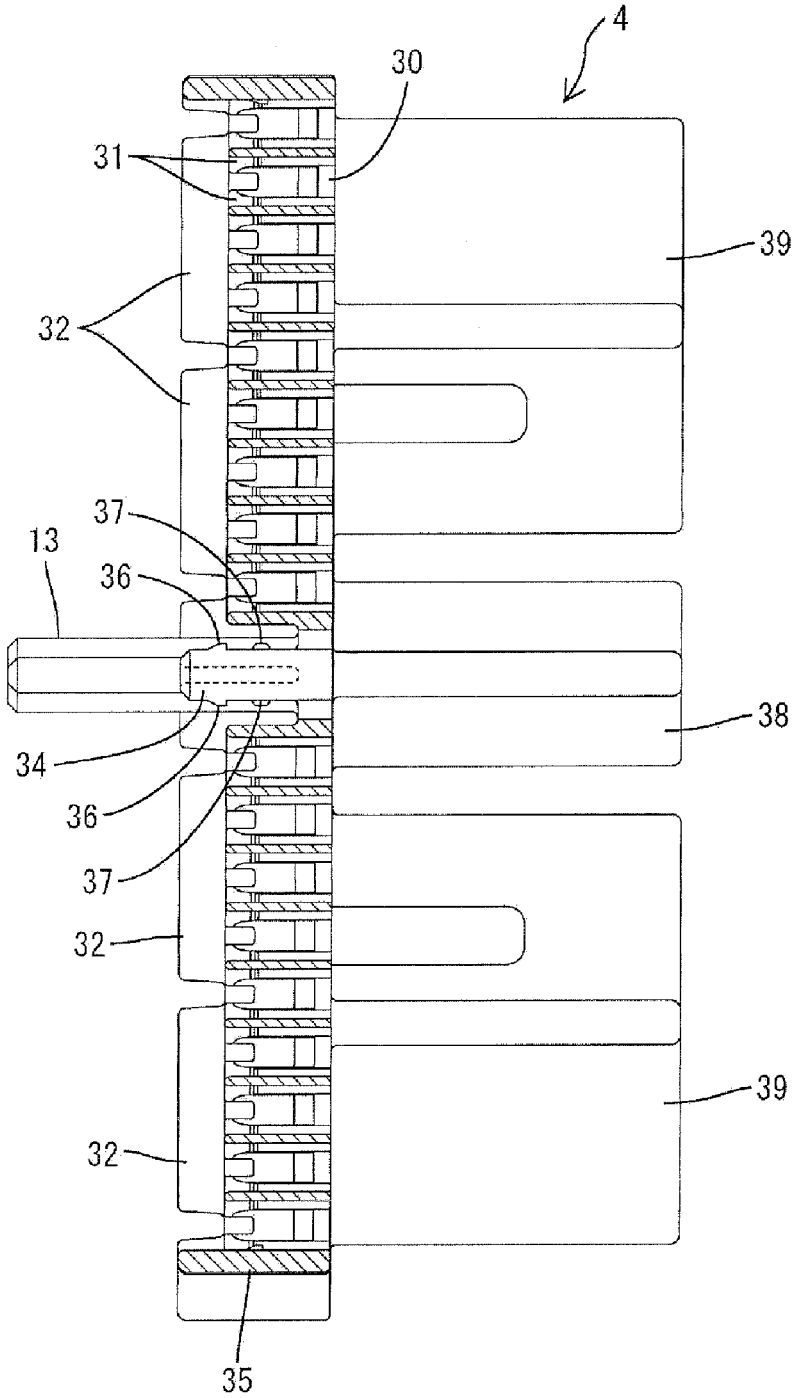
FIG. 12 is a section along E-E of FIG. 11.

As shown in FIG. 12, locking surfaces of the partial locking projections 36 are substantially perpendicular to an inserting direction of the locking shafts 34, whereas surfaces of the full locking projections 37 engaged with and disengaged from the starting ends of the full locking grooves are arcuate or inclined. Therefore, the fully locked state can be canceled if the retainer 4 is pulled strongly when the retainer 4 is at the full locking position 2P.

A center projecting piece 38 projects in a substantially central part of the front surface of the base 28, and is substantially cross-shaped in front view. Two side projecting pieces 39 are arranged at substantially opposite widthwise sides of the center projecting piece 38 at substantially the same height. The center projecting piece 38 and the side projecting pieces 39 have the same projecting length. The left side projecting piece 39 in FIG. 11 has a first shape (e.g. an inverted T-shape) and the right projecting piece 39 has a second shape different from the first shape (e.g. a cross shape shorter than the center projecting piece 38). The projecting pieces 38, 39 assist the movements of the retainer 4 and guide a connecting operation with an unillustrated connector by fitting into guide grooves of the female connector. The projecting pieces 38, 39 have lengths so that their leading ends project from the opening edge of the receptacle 7 when the retainer 4 is at the partial locking position 1P, and are substantially aligned with the opening edge of the receptacle 7 when the retainer 4 is at the full locking position 2P.

The connector is assembled by positioning the lance housing 2 before the receptacle 7 of the housing main body 1 with the base plate 15 in the lead and inserting the lance housing 2 into the mounting space 10. The locks 22 of the respective eaves 20 of the lance housing 2 contact the hooking claws 14 to resiliently deform the eaves 20 towards the deformation spaces 21. The locks 22 pass the hooking claws 14 and restore resiliently when the lance housing 2 is fit properly into the mounting space 10. Thus, the hooking claws 14 and the locks 22 engage to hold the lance housing 2 in the housing main body 1. During and after this operation, an operator can visually confirm the engaged state of the locks 22 from the front side of the receptacle 7. For example, the abnormal mounting of the lance housing 2 can be detected easily by seeing the narrow dimension of the deformation space 21 in height direction if the lance housing 2 is mounted insufficiently and any one of the locks 22 is engaged partly with the hooking claw 14.

The center projection 38 or the side projection 39 of the retainer 4 then is gripped and the retainer 4 is fit into the receptacle 7 from the front until the retainer 4 contacts the front surface of the lance housing 21. The guiding shaft 13 is inserted into the window 24 of the lance housing 2 and into the insertion recess 12 of the housing main body 1 to position the lance housing 2. Leading ends of the locking shafts 34 enter the retainer locking holes 25 of the lance housing 2 and the partial locking projections 36 engage the starting ends of the partial locking grooves 26 to hold the retainer 4 in the lance housing 2.

The respective lance restricting pieces 31 of the retainer 4 have not entered or only slightly entered the deformation spaces 18A for the corresponding lances 18 when the retainer 4 is at the partial locking position 1P and the lances 18 can deform. Accordingly, the small terminals 3B can be inserted into the small cavities 5B from behind. As a result, the small terminals 3B resiliently deform the lances 18 towards the respective deformation spaces 18A and engage with the lances 18 after the passing them. The large terminals 3B similarly are inserted into the corresponding large cavities 5A to be retained by the lances 6.

Forces act to push the lance housing 2 forward as the small terminals 3B are being inserted. However, the leading ends of the unlock preventing pieces 32 are fit lightly in the deformation spaces 21 for the respective eaves 20 when the retainer 4 is partly locked (position 1P) to prevent deformations of the eaves 20 towards the deformation spaces 21. This strengthens the engaged state of the locks 22 and the hooking claws 14 so that the lance housing 2 cannot come out as the small terminals 3B are inserted.

The retainer 4 is moved to the full locking position 2P after the terminals 3A, 3B are inserted so that the full locking projections 37 engage the starting ends of the full locking grooves 27. As the retainer 4 is moved from the partial locking position 1P to the full locking position 2P, the center projection 38 and the side projections 39 are inserted until their front ends align with the opening edge of the receptacle 7. Additionally, the lance restricting pieces 31 enter more deeply into the deformation spaces 18A for the lances 18 to prevent the deformations of the lances 18. Thus, the small terminals 3B are retained reliably. Further, the respective unlock preventing pieces 32 are inserted more deeply into the deformation spaces 21 for the respective eaves 20. Hence, the engaged state of the locks 22 and the hooking claws 14 is strengthened further to complete the assembling operation.

As described above, the deformation spaces 21 for the eaves 20 are exposed to the front of the receptacle 7 when the lance housing 2 is at least partly mounted into the housing main body 1. Thus, improper engagement of the locks 22 of the eaves 20 with the hooking claws 14 can be confirmed visually from the front of the receptacle 7. Accordingly, a transfer to the next assembling operation with the lance housing 2 incompletely mounted can be avoided. Since a mounting direction of the lance housing 2 and a direction in which the engaged state of the locks 22 of the eaves 20 is detected substantially coincide. Thus, the assembly of the lance housing 2 can be confirmed at the same time as the lance housing 2 is assembled.

The unlock preventing pieces 32 are in the deformation spaces 21 for the eaves 32 in the partly locked state of the retainer 4 to prevent the resilient deformations of the eaves 20 of the lance housing 2. Thus, a force for locking the lance housing 2 is strengthened and the lance housing 2 is less likely to come off while inserting the small-size terminals 3B. The locks 22 are left improperly deformed if the lance housing 2 is not mounted to a proper depth in the housing main body 1. Thus, the unlock preventing pieces 32 of the retainer 4 contact the locks 22 when the retainer 4 is mounted to the partial locking position 1P. Accordingly, the incompletely mounted state of the lance housing 2 can also be detected by the feeling at that time. Even in such a state, the retainer 4 can be pushed strongly so that the unlock preventing pieces 32 push the locks 22 and the position of the entire lance housing 2 can be corrected to the proper depth.

As described above, the connector can be miniaturized by including the locking lances 18 in the lance housing 2 separate from the housing main body 1. The miniaturization of the connector may thin the lance housing 2 and may reduce the locking forces of the eaves 20. However, the locking forces of the locks 22 are strengthened by the retainer 4, the miniaturization of the connector can be achieved without disadvantage.

The invention is not limited to the above described and illustrated embodiment. For example, the following embodiments are also embraced by the technical scope of the present invention as defined by the claims. Besides the following embodiments, various changes can be made without departing from the gist of the present invention.

The hooking claws 14 may not being projecting and may be recessed.

If sufficient locking forces can be obtained singly from the locks 22, it is not always necessary to prevent the unlocking by the retainer 4.

The unlock preventing pieces may not necessarily be formed on the retainer and may be formed on a member different from the retainer.

Although the invention is described for a male connector, the invention also is applicable to female connectors.

Although the connector has terminal fittings of different sizes and/or shapes, the invention is also applicable to connectors having one or more terminal fittings of a single shape and/or size.

What is claimed is:

1. A connector, comprising:

a housing main body with opposite front and rear ends, at least one rear cavity extending into the rear end for accommodating a rear part of a terminal fitting, a forwardly open mounting space formed in the housing main body, and at least one interlocking portion formed in the mounting space; and a lance housing mountable in the mounting space at the front of the housing main body, the lance housing being formed with at least one front cavity that communicates with the rear cavity for accommodating a front part of the terminal fitting when the lance housing is mounted in the mounting space, the lance housing having at least one lance resiliently engageable with the front part of the terminal fitting in the front cavity, at least one resiliently deformable lock beam on the lance housing and a forwardly open deformation space adjacent the lock beam, a locking portion formed on a part of the lock beam for engaging the interlocking portion to hold the lance housing in the mounting space of the housing main body.

2. The connector of claim 1, wherein the at least one resiliently deformable lock beam extends substantially forward from a rear part of the lance housing to form the at least one deformation space.

3. The connector of claim 1, wherein the front cavity of the lance housing is formed with at least one front-stop for limiting forward movement of the terminal fitting.

4. The connector of claim 1, wherein at least one insertion recess is formed in a wall surface where front ends of the rear cavities opens, wherein the insertion recess being configured for receiving a guiding shaft portion on the retainer.

5. The connector of claim 1, wherein at least one sealing tower is formed at a rear end of the housing main body for accommodating a resilient plug.

6. The connector of claim 1, wherein the housing main body comprises at least one large cavity for accommodating at least one large terminal fitting, the large cavity being formed unitarily with a locking lance.

7. The connector of claim 1, wherein at least one retainer is at least partly mountable to the lance housings from the front and includes at least one unlock preventing piece for entering the deformation space and preventing deformation of the lock beam.

8. The connector of claim 7, wherein the retainer has at least one lance restricting piece for entering a deformation space for the lance (6) and preventing deformation of the lance when the retainer is mounted to the lance housing.

9. The connector of claim 8, wherein the retainer is movable between a first position where the retainer is lightly mounted in the lance housing and at a second position where the retainer is deeply mounted in the lance housing.

10. The connector of claim 9, wherein the unlock preventing piece is in the deformation space for the lock beam when the retainer is at the first position, but the lance restricting piece is not in the deformation space for the lance to permit the terminal fitting to be inserted into the front and rear cavities, the unlock preventing piece and the lance restricting piece both being in the deformation spaces therefor when the retainer is at the second position.

* * * * *